United States Patent [19]

Fuchs et al.

[11] 4,359,919

[45] Nov. 23, 1982

[54] ROTARY PUNCH COMPRISING A BACKUP ROLL BEARING ON THE CUTTER ROLL

[75] Inventors: Siegfried Fuchs; Kurt Stemmler, both of Neuwied, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 135,837

[22] Filed: Mar. 31, 1980

[30] Foreign Application Priority Data

Mar. 29, 1979 [DE] Fed. Rep. of Germany ..... 2912458

[51] Int. Cl.[3] ..... B26F 1/00

[52] U.S. Cl. ..... 83/349; 83/344; 83/348

[58] Field of Search ..... 83/344, 348, 349

[56] References Cited

U.S. PATENT DOCUMENTS

| | | | |
|---|---|---|---|
| 3,073,196 | 1/1963 | Marcalus | 83/678 X |
| 3,448,684 | 6/1969 | Cardinet et al. | 83/344 X |
| 3,611,855 | 10/1971 | Thousand, Jr. | 83/349 X |
| 3,847,045 | 11/1974 | Willhite, Jr. | 83/349 X |
| 4,205,596 | 6/1980 | Chesnut | 83/344 |

*Primary Examiner*—James M. Meister

*Attorney, Agent, or Firm*—Allison C. Collard; Thomas M. Galgano

[57] ABSTRACT

A rotary punch for punching envelope blanks from moving webs of paper or the like or for making shaped cuts from prepared envelope blanks has a backup roll which bears on a cutter roll. The punch is characterized by the provision of intermediate bearings with an adjustable member therebetween. This precludes unwanted movements in the bearings between the two rolls due to varying cutting and out-of-balance forces, the adjustable member making it possible to correct the between-axes distance to suit cutter wear.

4 Claims, 5 Drawing Figures

ROTARY PUNCH COMPRISING A BACKUP ROLL BEARING ON THE CUTTER ROLL

The invention relates to a rotary punch of the type consisting of a backup roll bearing on the cutter roll. More particularly, the invention relates to a rotary punch for punching envelope blanks from moving webs of paper or the like or for making shaped cuts in prepared envelope blanks.

In known rotary punches of this kind the cutter roll bears on the backup roll by way of cylinder bearers known from the printing machine art. The cylinder bearers have two functions—to preclude movements between the two rolls which may be caused by changing, cutting and out-of-balance forces, and to obviate misadjustments of the cutter roll relative to the backup roll which might destroy the cutter and the backup roll.

Rotary punches having cylinder bearers perform their duties only at the cost of considerable disadvantages, chief amongst which is that adjustment of the between-axes distance of the two rolls to take up unavoidable wear of the cutter requires complex and time-consuming grinding over all of the complete cutter roll including the cylinder bearers. Another considerable disadvantage of cylinder bearers is that the backup roll must be a rotating roll running at the same angular velocity as the cutter roll, yet if optimum cutting results are to be achieved, it is often necessary to stop the backup roll or at least effect rotation of the same at a slower speed than the cutter roll. Another factor militating against the use of cylinder bearers on cutting apparatuses is the effect of the considerable yield of dust associated with the cutting of paper. The dust cakes on the cylinder bearers and forces the two rolls apart from one another, which is detrimental not only to the cutting operation, but also to the life of the bearings.

It is therefore, the object of the invention to provide a rotary cutter which obviates movements in the bearings between the two rolls due to varying cutting and out-of-balance forces but which makes it possible to correct the between-axes distance to adapt the same to cutter wear.

This object is attained by the present invention by the provision of intermediate bearings with an adjustable member therebetween.

An advantage of this solution of the problem is that bearing play is obviated, so that unwanted movements in the bearings between the two rolls due to varying cutting and out-of-balance forces are precluded, the adjustable-thickness members making it possible to correct the between-axes distance to suit cutter wear.

An embodiment of the rotary punch will be described in greater detail hereinafter with reference to the accompanying diagrammatic drawings wherein.

Figure 1:
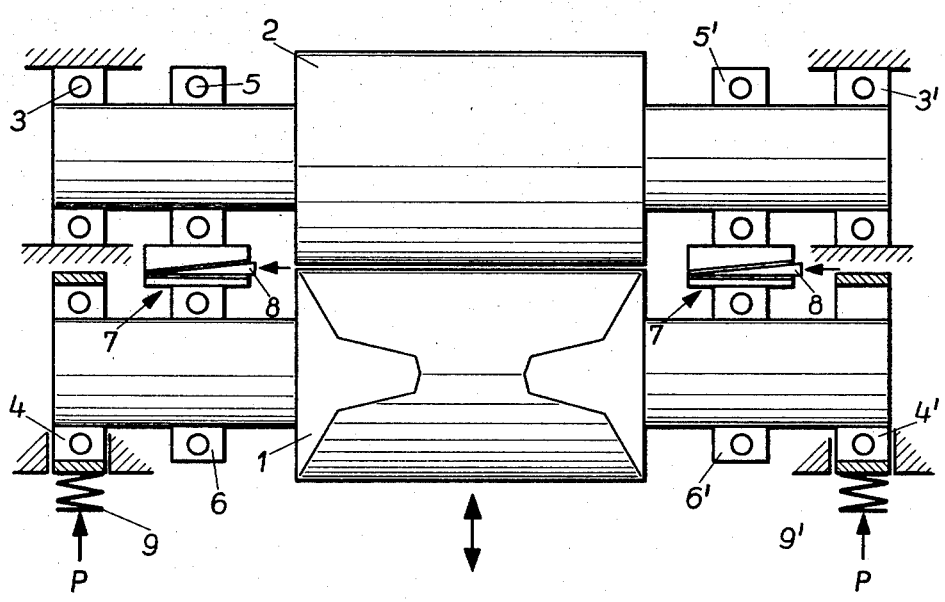
FIG. 1 is a diagrammatic front view illustrating the principle of the rotary punch embodying the present invention.

Referring now in detail to the drawings, as will be apparent from FIG. 1, the rotary punch comprises a cutter roll 1 cooperating with a backup roll 2. Backup roll 2 is rigidly mounted in a machine frame by way of main bearings 3, 3', whereas main bearings 4, 4' of cutter roll 1 are mounted in the machine frame for vertical movement. In addition to the main bearings, backup roll 2 has two intermediate or supplementary bearings 5, 5' and cutter roll 1 has two intermediate or supplementary bearings 6, 6'.

A member 7 is disposed between intermediate bearings 5 and 6 and a member 7' is disposed between intermediate bearings 5' and 6'; the thickness of members 7, 7' is variable, as indicated in the present case by a wedge 8, 8', respectively. The thickness of member 7, 7' is such that with the punch in the operative position, intermediate bearings 5, 5' of the backup roll bear by way of the respective members 7, 7' on the intermediate bearings 6, 6', respectively, of cutter roll 1.

The rotary punch operates as follows:

To bring the punch into its operative position, a resilient member, shown in the present case as a compression spring 9, 9', respectively, applies in the direction indicated by arrows P a force sufficient to overcome the weight of the two rolls, including the cutting and out-of-balance forces arising in operation. The result of the force acting in the direction P is that, initially, only the cutter roll 1 rises until its intermediate bearings 6, 6' engage by way of members 7, 7', respectively, with the intermediate bearings 5, 5' of backup roll 2. Thereafter, cutter roll 1 and backup roll 2 continue to rise together by an amount determined by the clearance in main bearings 3, 3' of backup roll 2. When the final position of the movement has been reached, the bearing clearance has been eliminated from all the bearings, as a result of which there is no chance of unwanted movements occurring in response to varying loads between the cutter roll and the backup roll.

The distance between the cutter roll and the backup roll is therefore determined by the thickness of members 7, 7'. If it is required to reduce this distance after prolonged operation of the apparatus to compensate for cutter wear, wedges 8, 8' are shifted in the opposite direction to the arrows until the height of member 7, 7' has been reduced by an amount corresponding to cutter wear. Because of the force P applied continuously by way of the springs or the like, 9, 9', cutter roll 1 rises by the same amount, so that cutter wear is compensated for.

In practice, cutter wear, and therefore the necessary movement to compensate for cutter wear, is somewhere in the order of magnitude of 0.01 mm. Control of the adjustment of the members 7, 7' must therefore be much finer than as shown in the diagram of FIG. 1.

Figure 2:
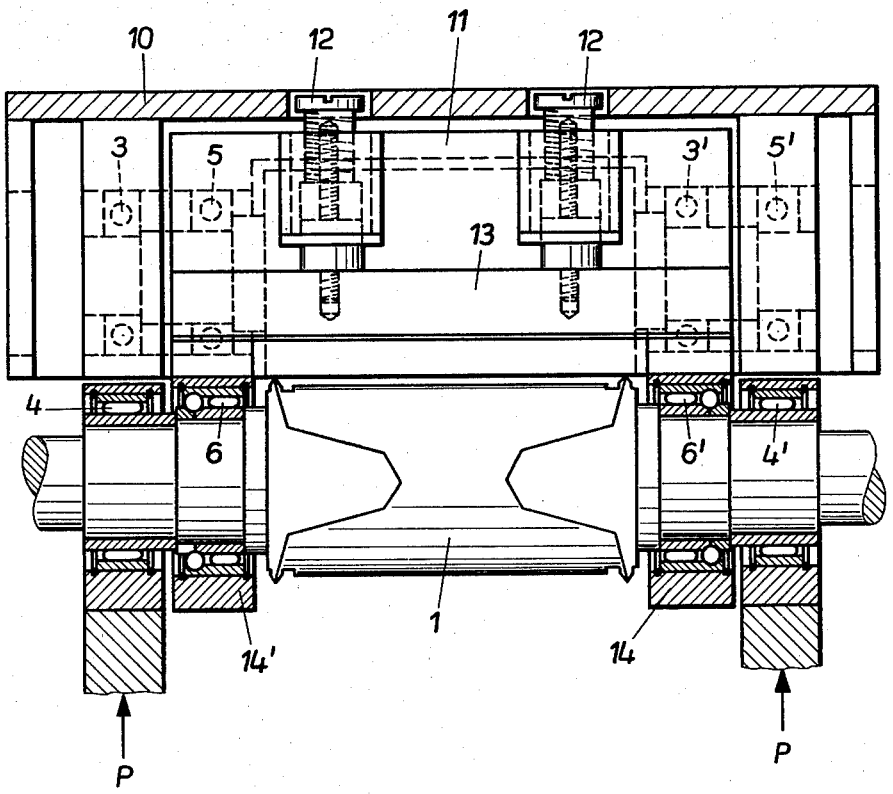
FIG. 2 is a front view of a rotary punch having a rotating backup roll.
Figure 3:
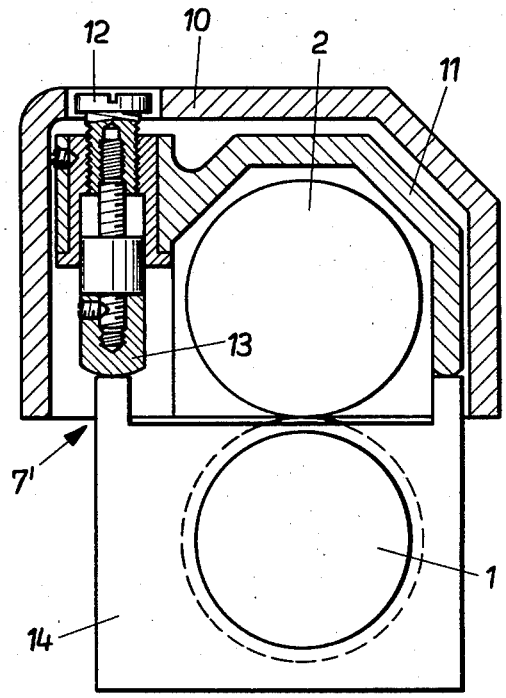
FIG. 3 is a side view of the punch shown in FIG. 2.

FIGS. 2 and 3 illustrate a cutting apparatus which has members 7, 7' capable of very fine adjustment and which will now be described in greater detail. As in the case of the apparatus shown in FIG. 1, the apparatus shown in FIGS. 2 and 3 comprises a cutter roll 1 cooperating with a backup roll 2. Backup roll 2 is rigidly mounted by way of its main bearings 3, 3' in a bridge 10 which is rigidly connected to the machine frame. The main bearings 4, 4' of the cutter roll are mounted in the machine frame for vertical adjustment.

As in the case of FIG. 1, the two rolls each have their respective intermediate bearings 5, 5' and 6, 6' which bear against one another in pairs by way of an adjustable-thickness member 7', the latter of which is in the form of an inner bridge 11 which is mounted on intermediate bearings 5, 5' of backup roll 2. Bridge 11 has a strip or the like 13 which is vertically adjustable by means of micrometer screws 12. Inner bridge 11 bears, by way of strips 13, on two substantially rectangular discs 14, 14' disposed on the cutter roll intermediate bearings 6, 6', respectively.

The biasing force P is applied by way of hydraulic cylinders (not shown) on the main bearings 4, 4' of the cutter roll 1 and, by way of discs 14, 14' on intermediate bearings 6, 6', presses the cutter roll onto strip 13 and therefore onto bridge 11, with the result that, by way of intermediate bearings 5, 5', backup roll 2 rises to the extent permitted by the bearing clearance in main bearings 3, 3'. The micrometer screws 12 are adjusted to vary the between-axes distance of the two rolls 1, 2. If screws 12 are adjusted, for instance, so that strip 13 rises, cutter roll 1 shifts, because of the continuous force P, until discs 14, 14' reengage on both sides with inner bridge 11 and strip 13.

In the embodiment shown in FIGS. 2 and 3, backup roll 2 is driven by frictional engagement with the material moving between the two rolls 2 and 1. The backup roll can have its own drive, in which event it can run at any speed. The best cutting results are obtained, except for a few special materials, with the backup roll 2 stationary. The backup roll 2 can be made stationary by being locked. Clearly, however, in this event, there is no need at all for the backup roll to be mounted in rolling bearings. A description will therefore be given hereinafter of a very advantageous embodiment of a cutting apparatus having a stationary backup roll.

Figure 5:
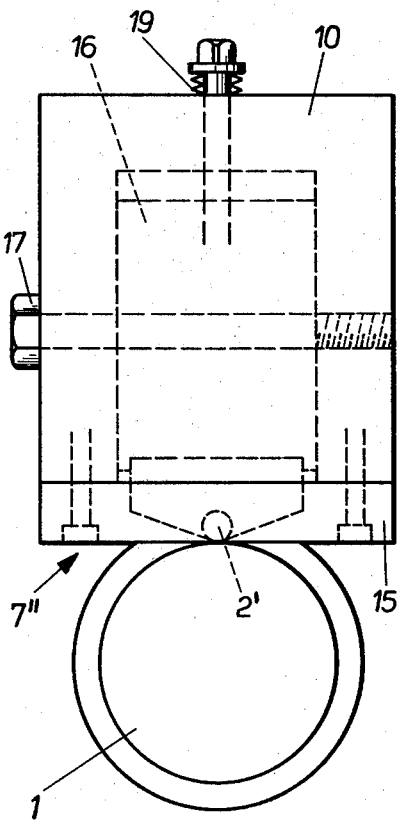
FIG. 5 is a side view of the punch shown in FIG. 4.
Figure 4:
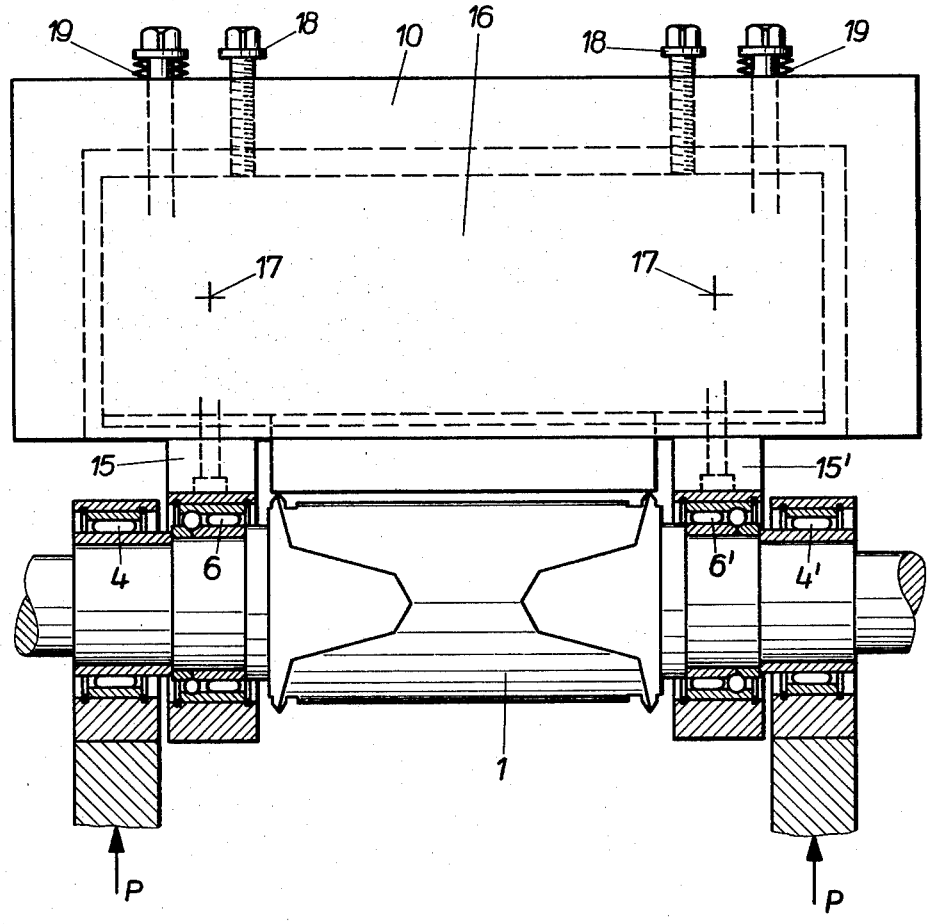
FIG. 4 is a front view of a rotary punch having a stationary backup roll.

FIGS. 4 and 5 show such a cutting apparatus, again comprising as its main elements the known cutter roll 1 cooperating with a backup roll 2'. As in the previous example, backup roll 2' is mounted in a bridge 10' rigidly secured to the machine frame. In a known manner, cutter roll 1 is mounted in vertically adjustable main bearings 4, 4' beside which the intermediate bearings 6, 6' are disposed. Through the agency of hydraulic cylinders (not shown), a force P acting in the direction of the arrows is applied to main bearings 4, 4' and lifts cutter roll 1 until its intermediate bearings 6, 6' abut stop strips or the like 15, 15', respectively, disposed on bridge 10'. Cutter roll 1 is therefore now located relatively to the position of bridge 10'.

To adjust the distance between the axes of cutter roll 1 and backup roll 2', the same is secured by clamping elements (not shown) on a strip or the like 16 disposed in bridge 10 for vertical movement. The adjustable member 7 shown in FIG. 1 is therefore represented in the present embodiment by the bridge 10 in association with the strips 15, 15' and the vertically adjustable strip 16 and has the general reference numeral 7''.

Adjustment is very simple and will be apparent from FIGS. 4 and 5. After screws or bolts 17 have been slackened, strip 16 with backup roll 2' clamped on it can be moved, by turning the adjusting screws 18 against or in the direction of the biasing force applied by the springs 19, until optimum cutting results are achieved. Upon the completion of adjustment, strip 16 and therefore backup roll 2' are secured in a non-displaceable manner in bridge 10 by the screws 17 being tightened.

Thus, while only several embodiments of the present invention have been shown and described, it will be obvious that many changes and modifications may be made thereunto, without departing from the spirit and scope of the invention.

What is claimed is:

1. In a rotary punch for punching envelope blanks from moving webs of paper or the like or for making shaped cuts in prepared envelope blanks of the type including a cutter roll and a backup roll disposed for engagement with the cutter roll, the improvement comprising:

a pair of vertically-adjustable main bearings in which said cutter roll is mounted, said main bearings each having an outer ring;

biasing means for producing a force acting in the direction of said backup roll which is operative on said outer rings of said main bearings;

a bridge in which said backup roll is mounted in a preadjustable, non-rotating fixed position; and supplementary bearings for said cutter roll which contact and abut said bridge.

2. The punch according to claim 1, wherein said biasing means comprise hydraulic cylinders.

3. The punch according to claim 1, wherein said bridge has a vertically adjustable strip in which the backup roll is retained in a non-displaceable manner.

4. The punch according to claim 3, wherein said bridge has stop strips which are in contact with said supplementary bearings of said cutter roll.

* * * * *